US009523241B2

(12) United States Patent
Mageren

(10) Patent No.: US 9,523,241 B2
(45) Date of Patent: Dec. 20, 2016

(54) MULTI SHOT ACTIVATION SYSTEM

(71) Applicant: HALLIBURTON ENERGY SERVICES, INC.

(72) Inventor: Olivier Mageren, Jette (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/784,011

(22) PCT Filed: Dec. 30, 2014

(86) PCT No.: PCT/US2014/072782
§ 371 (c)(1),
(2) Date: Oct. 12, 2015

(87) PCT Pub. No.: WO2016/108854
PCT Pub. Date: Jul. 7, 2016

(65) Prior Publication Data

US 2016/0312539 A1 Oct. 27, 2016

(51) Int. Cl.
*E21B 10/32* (2006.01)
*E21B 10/34* (2006.01)
*E21B 7/28* (2006.01)

(52) U.S. Cl.
CPC ..... *E21B 10/322* (2013.01); *E21B 7/28* (2013.01); *E21B 10/34* (2013.01)

(58) Field of Classification Search
CPC ..... E21B 7/28; E21B 10/32; E21B 10/322; E21B 10/325; E21B 29/005
(Continued)

(56) References Cited

U.S. PATENT DOCUMENTS 2,684,120 A 7/1954 Brown
2,879,038 A 3/1959 Johnson
(Continued)

FOREIGN PATENT DOCUMENTS

EP 2692982 2/2014
WO WO2014116934 7/2014
(Continued)

OTHER PUBLICATIONS

International Search Report/Written Opinion Issued by Korean Patent Office on Sep. 22, 2015, PCT/US2014/072782 filed Dec. 30, 2014, 13 pgs.
(Continued)

*Primary Examiner* — Kenneth L Thompson
(74) *Attorney, Agent, or Firm* — Alan Bryson; Parker Justiss, P.C.

(57) ABSTRACT

An activation assembly for a wellbore tool positionable in a wellbore includes a housing, a wellbore tool coupled to the housing, and a tool activator operatively coupled to the wellbore tool. The tool activator includes first and second fixedly connected circular disks, each of which includes a plurality of radially projecting teeth disposed around an outer circumferential surface of the disk. The disks are rotatably mounted about a longitudinal axis of the housing. The tool activator further includes a key member having a head portion engageable with the teeth of the first and second disks. The key member is located within the housing such that the disks rotate through a limited angular distance in response to movement of the key member.

20 Claims, 7 Drawing Sheets

(58) Field of Classification Search
USPC ..... 175/342, 344, 384, 406; 166/237
See application file for complete search history.

(56) References Cited

U.S. PATENT DOCUMENTS

| | | | | |
|---|---|---|---|---|
| 4,291,724 | A * | 9/1981 | Miller | B65G 51/24 137/555 |
| 4,491,187 | A | 1/1985 | Russell | |
| 4,573,536 | A * | 3/1986 | Lawrence | E21B 31/03 166/178 |
| 4,798,246 | A | 1/1989 | Best | |
| 5,036,928 | A | 8/1991 | Mark | |
| 6,039,122 | A * | 3/2000 | Gonzalez | E21B 33/068 166/379 |
| 6,142,250 | A | 11/2000 | Griffin et al. | |
| 6,991,046 | B2 | 1/2006 | Fielder et al. | |
| 7,100,713 | B2 | 9/2006 | Tulloch | |
| 7,108,082 | B1 | 9/2006 | Anthony et al. | |
| 7,168,493 | B2 | 1/2007 | Eddison | |
| 7,234,544 | B2 * | 6/2007 | Kent | E21B 7/067 175/306 |
| 7,350,596 | B1 | 4/2008 | Attaya | |
| 7,588,101 | B2 | 9/2009 | Lynde et al. | |
| 7,591,329 | B2 | 9/2009 | Perpezat et al. | |
| 7,802,627 | B2 * | 9/2010 | Hofman | E21B 34/14 137/38 |
| 8,028,763 | B2 | 10/2011 | Mackenzie | |
| 8,141,628 | B2 | 3/2012 | Hart | |
| 8,191,416 | B2 | 6/2012 | Kuchuk et al. | |
| 8,365,842 | B2 | 2/2013 | Hall et al. | |
| 9,004,179 | B2 * | 4/2015 | Chauffe | E21B 34/06 166/250.04 |
| 2004/0084183 | A1 | 5/2004 | Zupanick | |
| 2005/0092526 | A1 | 5/2005 | Fielder et al. | |
| 2012/0199363 | A1 | 8/2012 | Hu | |
| 2012/0298423 | A1 | 11/2012 | Cruickshank et al. | |
| 2013/0248252 | A1 | 9/2013 | Oesterberg et al. | |
| 2013/0292175 | A1 | 11/2013 | Radford et al. | |
| 2014/0246236 | A1 | 9/2014 | Radford et al. | |
| 2015/0218904 | A1 * | 8/2015 | Chauffe | E21B 33/128 166/250.01 |
| 2016/0024850 | A1 * | 1/2016 | Ringgenberg | E21B 23/006 175/57 |

FOREIGN PATENT DOCUMENTS

| | | |
|---|---|---|
| WO | WO2014133487 | 9/2014 |
| WO | WO2015084400 | 6/2015 |

OTHER PUBLICATIONS

Schlumberger, "Rhino XC," 12-DT-0078, 2012, 4 pgs.
Weatherford®, "RipTide™ Drilling Reamer," 7038.03, 2004-2012, 12 pgs.
National Oilwell Varco, "ANDERREAMER™ Concentric Underreamer," D921004324-MKT-001 Rev 01, 2012, 4 pgs.
Baker Hughes, "GaugePro XPR Beats AFE in First Salt Drilling Application," Case History, 27836, 2010, 1 pg.

* cited by examiner

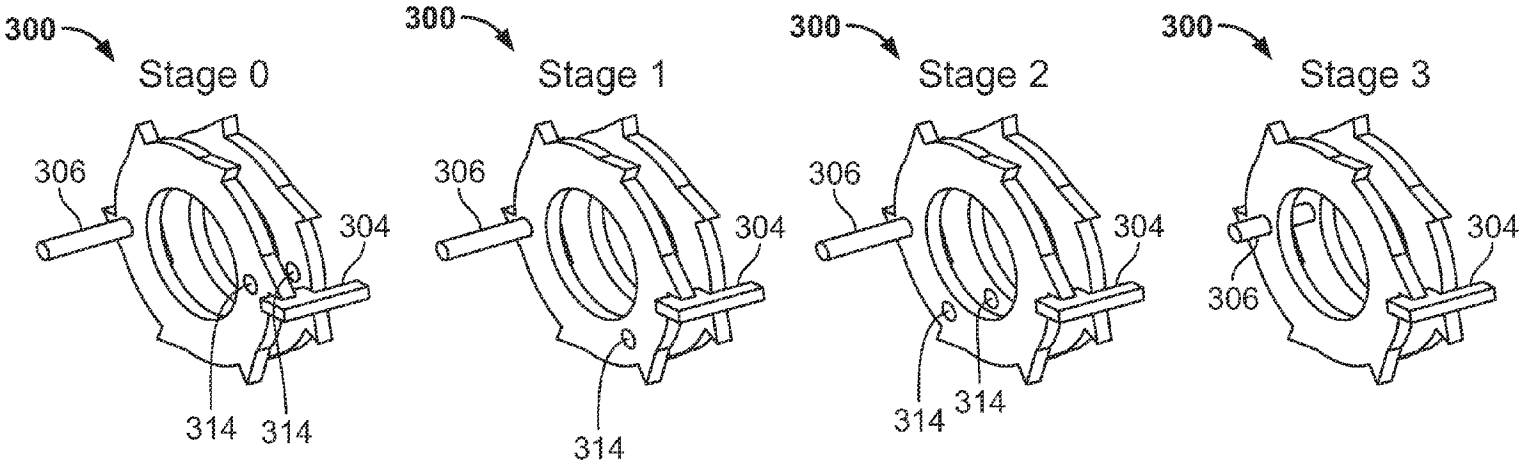
FIG. 6A
FIG. 6B
FIG. 6C
FIG. 6D
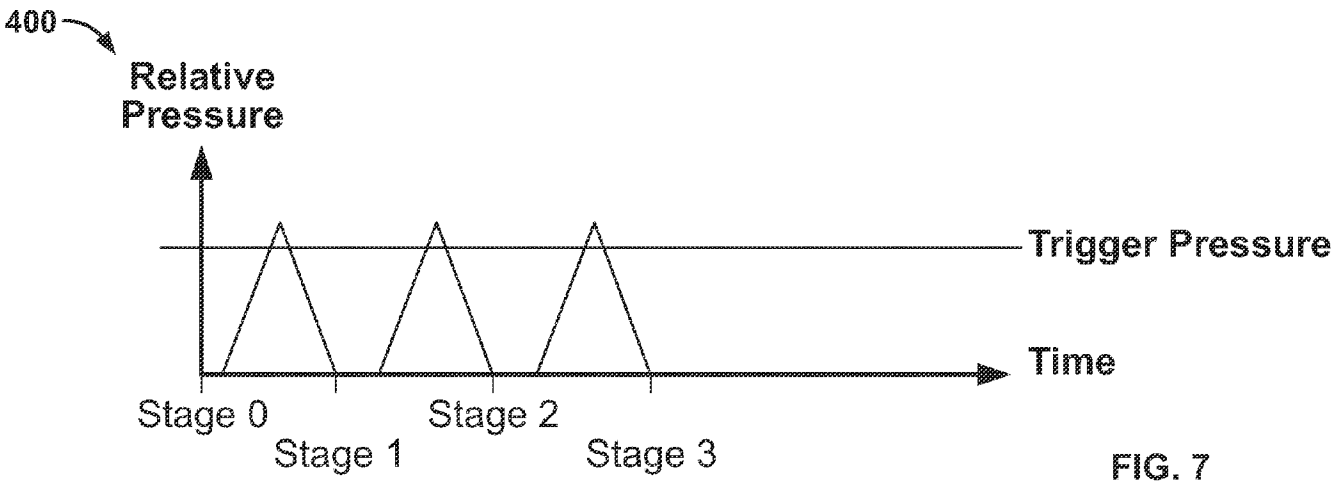
FIG. 7

MULTI SHOT ACTIVATION SYSTEM

TECHNICAL FIELD

The present disclosure relates to systems, assemblies, and methods for activating wellbore tools.

BACKGROUND

In connection with the recovery of hydrocarbons from the earth, wellbores are generally drilled using a variety of different methods and equipment. According to one common method, a roller cone bit or fixed cutter bit is rotated against the subsurface formation to form the wellbore. The rotating bit is suspended in the wellbore by a tubular drill string. Drilling fluid is pumped through the drill string and discharged at or near the drill bit. Among other things, the drilling fluid helps to keep the drill bit cool and clean during drilling. In many systems, various wellbore tools (e.g., near-bit reamers and under-reamers) are incorporated in a bottomhole assembly at the lower end of the drill string to facilitate drilling operations. Such tools often require remote activation within the downhole environment of the wellbore.

DESCRIPTION OF DRAWINGS

FIGS. 6A-6D are progressive diagrams illustrating a tool activation sequence.

FIG. 7 is a graph illustrating a protocol for operating the tool activator according to the activation sequence of FIGS. 6A-6D.

DETAILED DESCRIPTION

Figure 1:
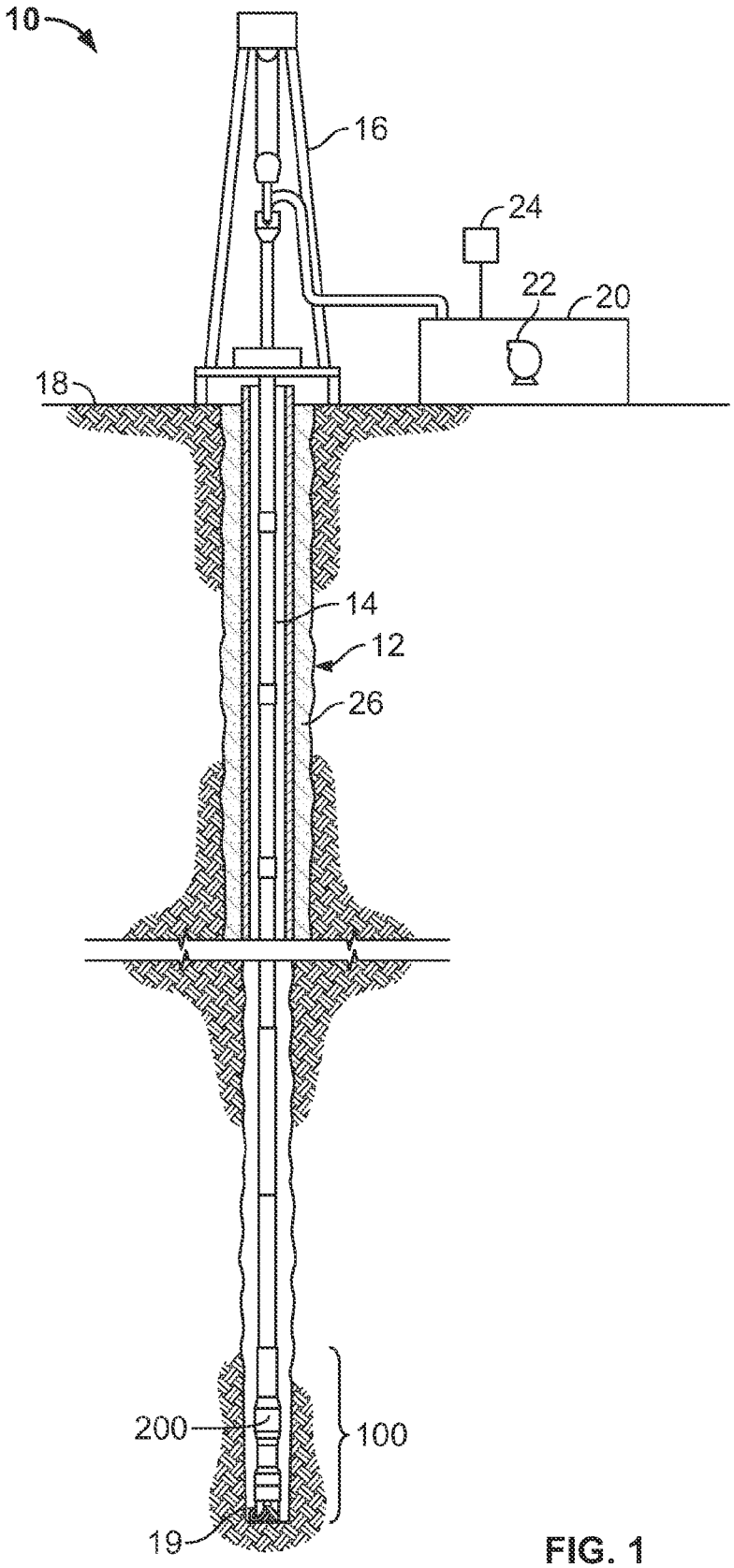
FIG. 1 is a schematic illustration of a drilling rig including a bottomhole assembly equipped with a wellbore tool deployable by a tool activator.

FIG. 1 is a diagram of an example drilling rig 10 for drilling a wellbore 12. The drilling rig 10 includes a drill string 14 supported by a derrick 16 positioned generally on an earth surface 18. The drill string 14 extends from the derrick 16 into the wellbore 12. A bottomhole assembly 100 at the lower end portion of the drill string 14 includes a wellbore tool 200 (e.g., a reamer tool) and a drill bit 19. Various other wellbore tools to facilitate drilling operations may also be included but are known shown. As discussed below with reference to FIG. 2, the wellbore tool 200 is a reamer tool in this example. The drill bit 19 can be a fixed cutter bit, a roller cone bit, or any other type of bit suitable for drilling a wellbore. The drill bit 19 can be rotated by surface equipment that rotates the entire drill string 14 and/or by a subsurface motor (often called a "mud motor") supported in the drill string.

A drilling fluid supply system 20 includes one or more mud pumps 22 (e.g., duplex, triplex, or hex pumps) to forcibly flow drilling fluid (often called "drilling mud") down through an internal flow passage of the drill string 14 (e.g., a central bore of the drill string). The drilling fluid supply system 20 may also include various other components for monitoring, conditioning, and storing drilling fluid. A controller 24 operates the fluid supply system 20 by issuing operational control signals to various components of the system. For example, the controller 24 may dictate operation of the mud pumps 22 by issuing operational control signals that establish the speed, flow rate, and/or pressure of the mud pumps 22.

In some implementations, the controller 24 is a computer system including a memory unit that holds data and instructions for processing by a processor. The processor receives program instructions and sensory feedback data from memory unit, executes logical operations called for by the program instructions, and generates command signals for operating the fluid supply system 20. An input/output unit transmits the command signals to the components of the fluid supply system and receives sensory feedback from various sensors distributed throughout the drilling rig 10. Data corresponding to the sensory feedback is stored in the memory unit for retrieval by the processor. In some examples, the controller 24 operates the fluid supply system 20 automatically (or semi-automatically) based on programmed control routines applied to feedback data from the sensors throughout the drilling rig. In some examples, the controller operates the fluid supply system 20 based on commands issued manually by a user.

The drilling fluid is discharged from the drill string 14 through or near the drill bit 19 to assist in the drilling operations (e.g., by lubricating and/or cooling the drill bit), and subsequently routed back toward the surface 18 through an annulus 26 formed between the wellbore 12 and the drill string 14. The re-routed drilling fluid flowing through the annulus 26 carries cuttings from the bottom of the wellbore 12 toward the surface 18. At the surface, the cuttings can be removed from the drilling fluid and the drilling fluid can be returned to the fluid supply system 20 for further use.

In the foregoing description of the drilling rig 10, various items of equipment, such as pipes, valves, fasteners, fittings, etc., may have been omitted to simplify the description. However, those skilled in the art will realize that such conventional equipment can be employed as desired. Those skilled in the art will further appreciate that various components described are recited as illustrative for contextual purposes and do not limit the scope of this disclosure. Further, while the drilling rig 10, is shown in an arrangement that facilitates straight downhole drilling, it will be appreciated that directional drilling arrangements are also contemplated and therefore are within the scope of the present disclosure.

Figure 2:
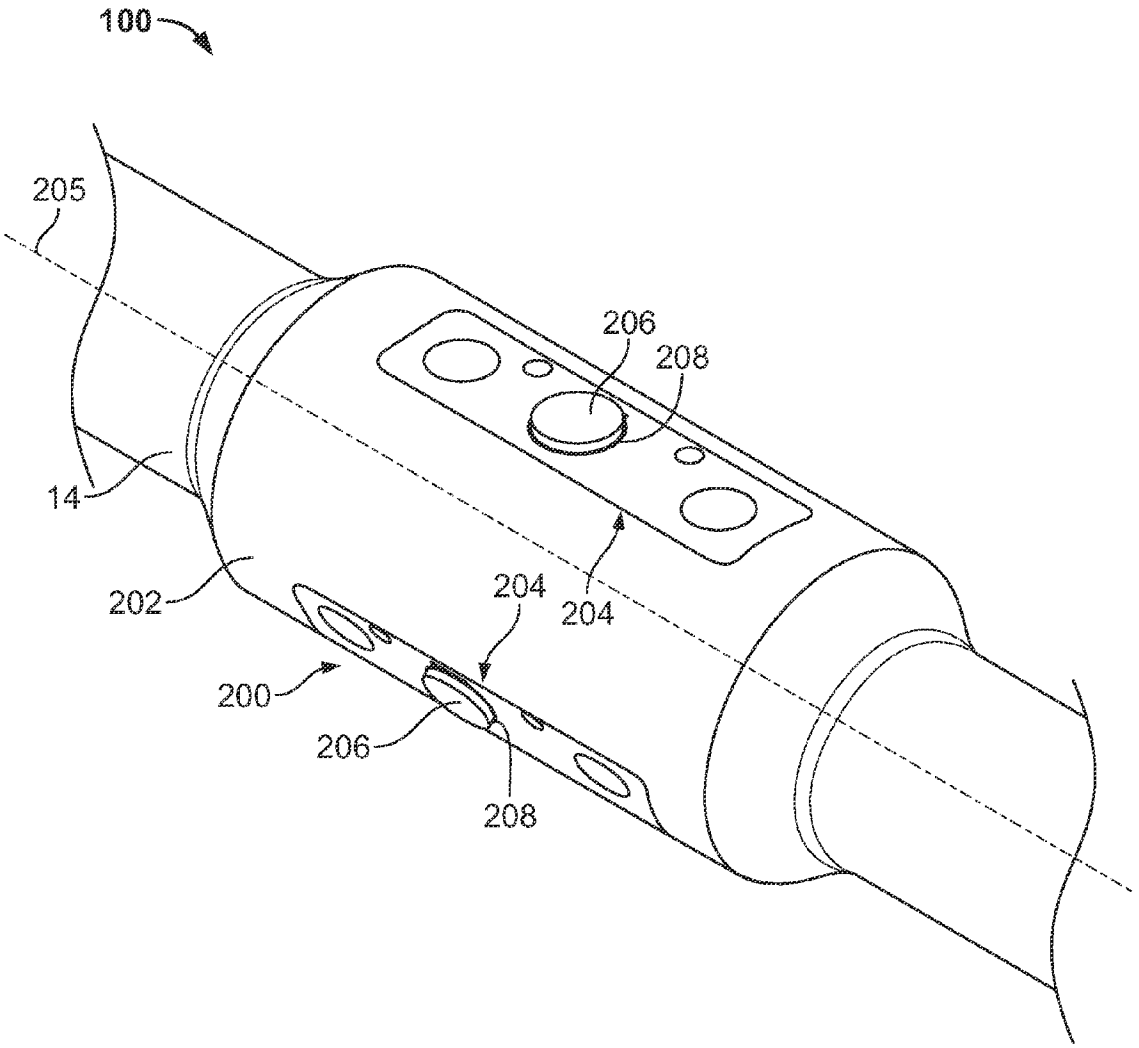
FIG. 2 is a perspective view of a partial bottomhole assembly including a reamer tool deployable by a tool activator.

FIG. 2 is a perspective view of a partial bottomhole assembly 100 located at the lower end of the drill string 14. As noted above, in this implementations, the bottomhole assembly 100 is equipped with a reamer tool 200. The reamer tool 200 includes a tubular housing 202 coupled to the drill string 14 and an arrangement of multiple cutting blocks 204 distributed circumferentially about the housing. The housing 202 defines a central longitudinal axis 205. In this example, the reamer tool 200 includes three cutting blocks 204 located at circumferential intervals of 120°. Of course, any suitable arrangement of cutting blocks may be used in various other embodiments and implementations without departing from the scope of the present disclosure.

Each of the cutting blocks 204 includes a cutter element 206. The cutter element 206 is movable between a retracted position to a deployed position. In the retracted position (not shown), the cutter element 206 is withdrawn into the housing 202. In the deployed position (illustrated in FIG. 2), the cutter element 206 extends radially outward from the housing 202 through an opening 208 to engage the wellbore wall. In some examples, the cutter element 206 is biased (e.g., by one or more linear springs) to move toward the deployed position (see FIGS. 4A and 4B). In the deployed position, the cutter elements 206 abrade and cut away the formation as the reamer tool 200 is rotated by the drill string 14, thereby expanding the diameter of the borehole. As described below, a rotating tool activator is incorporated in the housing 202 and used to adjust the cutter elements 206 to the deployed position.

In this example, the cutter elements 206 are illustrated as substantially circular cutting blocks that, for example, while in the deployed position, shear against the walls of a wellbore. However, suitable cutter elements can include additional or different components and features (e.g., a different shape). As one example, the cutter elements can include a blade with individual cutters (e.g., PDC cutter inserts, diamond insert cutters, hard-faced metal inserts, and/or others) affixed to the blade. In some examples, the cutter elements are affixed to a rotating disc and/or cone.

Figure 3:
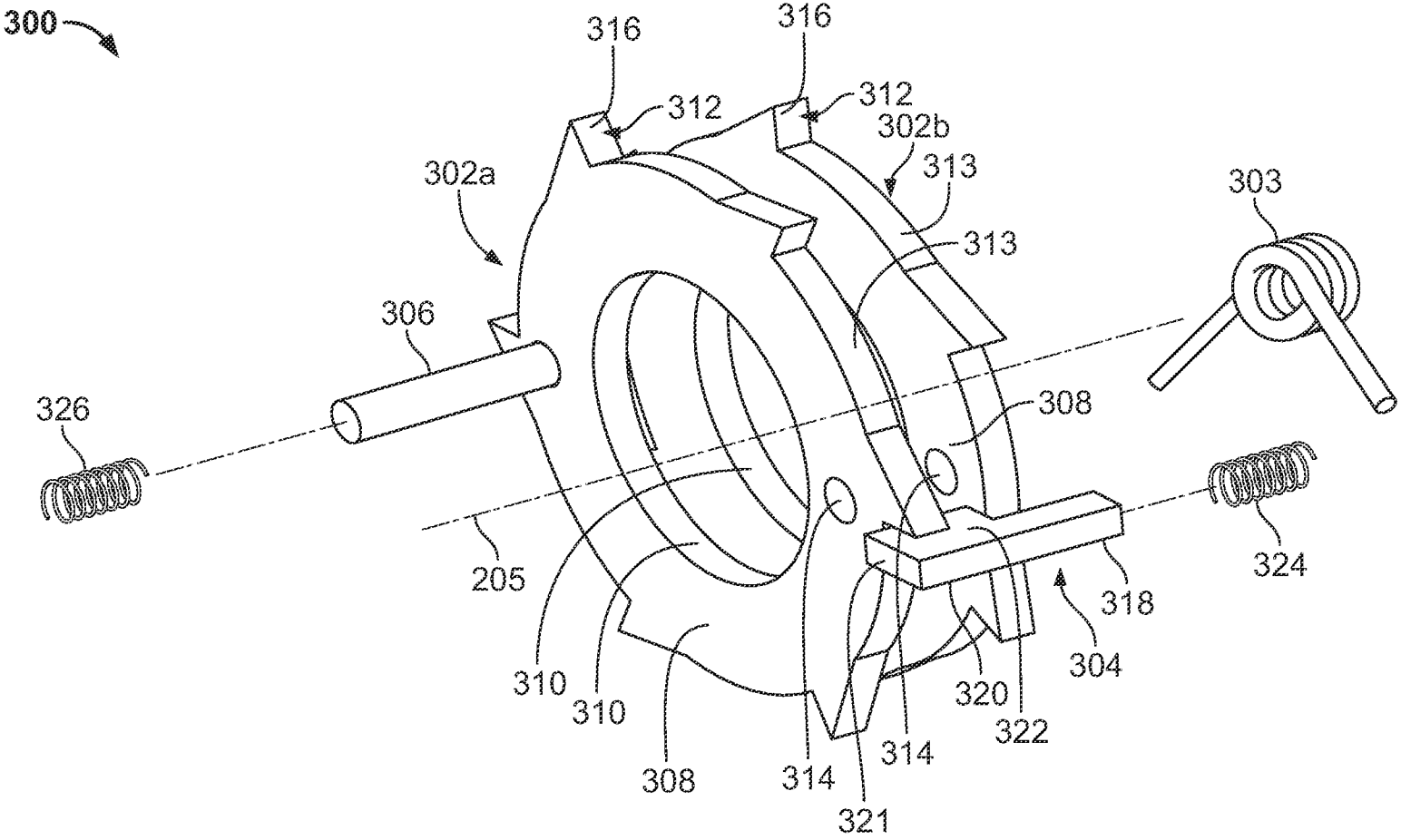
FIG. 3 is a diagram of a tool activator.

FIG. 3 is diagram of a tool activator 300 that can be used for facilitating operation of the reamer tool 200 from the retracted position to the deployed position. For sake of clarity and discussion, the tool activator 300 is illustrated in a deconstructed posture and outside of the housing 202. The tool activator 300 includes a pair of first and second disks 302*a* and 302*b*, a key member 304, and an activator pin 306. The disks 302*a* and 302*b* are fixed to one another (e.g., formed integrally with one another, or bound together by welding or a mechanical fastening system) and biased by a torsional spring 303 to rotate together about the central longitudinal axis 205 of the reamer tool housing 202. As will be described below, the key member 304 interfaces with the disks 302*a* and 302*b* to prevent rotational movement. The key member 304, however, can be moved on demand to release the disks 302*a* and 302*b* for rotation through a limited angular distance.

Each of the disks 302*a* and 302*b* includes a body portion 308 having a central opening 310 for mounting the disks 302*a* and 302*b* on a central drilling fluid flow tube (not shown) extending through the bottomhole assembly 100. The disks 302*a* and 302*b* also have a plurality of radially projecting teeth 312. As shown, the teeth 312 are distributed around the outer circumferential surface 313 of the disks 302*a* and 302*b*. Each of the disks 302*a* and 302*b* also includes a pin hole 314 for receiving the activator pin 306, as described below. The disks 302*a* and 302*b* are coupled to one another in a fixed coaxial and parallel-plane alignment with one another relative to the central longitudinal axis 205. The disks 302*a* and 302*b* are also oriented such that the respective pin holes 314 of the disks are in alignment.

The teeth 312 of the disks 302*a* and 302*b* are circumferentially-offset from one another, forming an alternating pattern with the tooth of one disk situated between two neighboring teeth of the other disk. The teeth 312 are wedged-shaped members that present a planar surface 316 for engagement with a mating portion of the key member 304. In this example, the arrangement of teeth 312 for each disk 302*a*, 302*b* are substantially identical in shape, size, number, and pattern. Other suitable configurations however can be used without departing from the scope of the present disclosure. For example, the number of teeth on either or both disks could be increased or decreased to change the angular distance of rotation by the disks in response to each movement of the key member.

The key member 304 includes a shaft portion 318 and a head portion 320. The head portion 320 of the key member 304 is radially aligned with the teeth of the disks 302*a* and 302*b*. That is, the key member 304 is located in the reamer tool housing 202 such that the teeth 312 and the head portion 320 are approximately the same radial distance from the central longitudinal axis 205. The head portion 320 of the key member 304 provides a planar surface 322 complementary to the planar engagement surface 316 of the teeth 312. In this example, the key member is movable in a direction parallel to the longitudinal axis 205 (i.e., a longitudinal direction) between a first position and a second position. In the first position, the head portion 320 is only engageable with the teeth 312 of the first disk 302*a*. In the second position, the head portion 320 is only engageable with the teeth 312 of the second disk 302*b*. The shaft portion 318 of the key member 304 interfaces with a linear spring 324 (e.g., a coil spring or a disk spring). The linear spring 324 urges the key member 304 towards the first position. So, movement of the key member 304 from the first position to the second position can be achieved by applying a force sufficient to overcome a spring force of the linear spring 324. Movement of the key member 304 back to the first position can be achieved by removing the applied force.

Figure 4A:
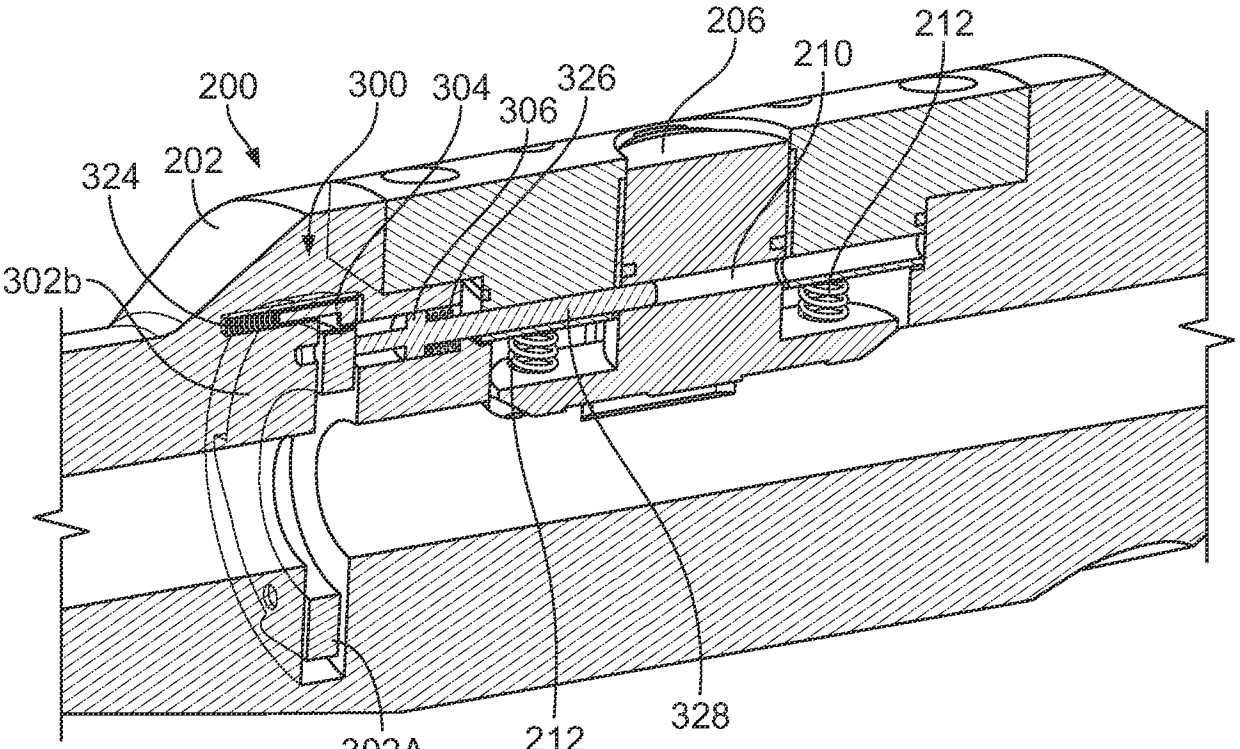
FIG. 4A is a cross-sectional view of a reamer assembly of FIG. 2 illustrating the tool activator of FIG. 3 holding the reamer tool in a retracted position.
Figure 4B:
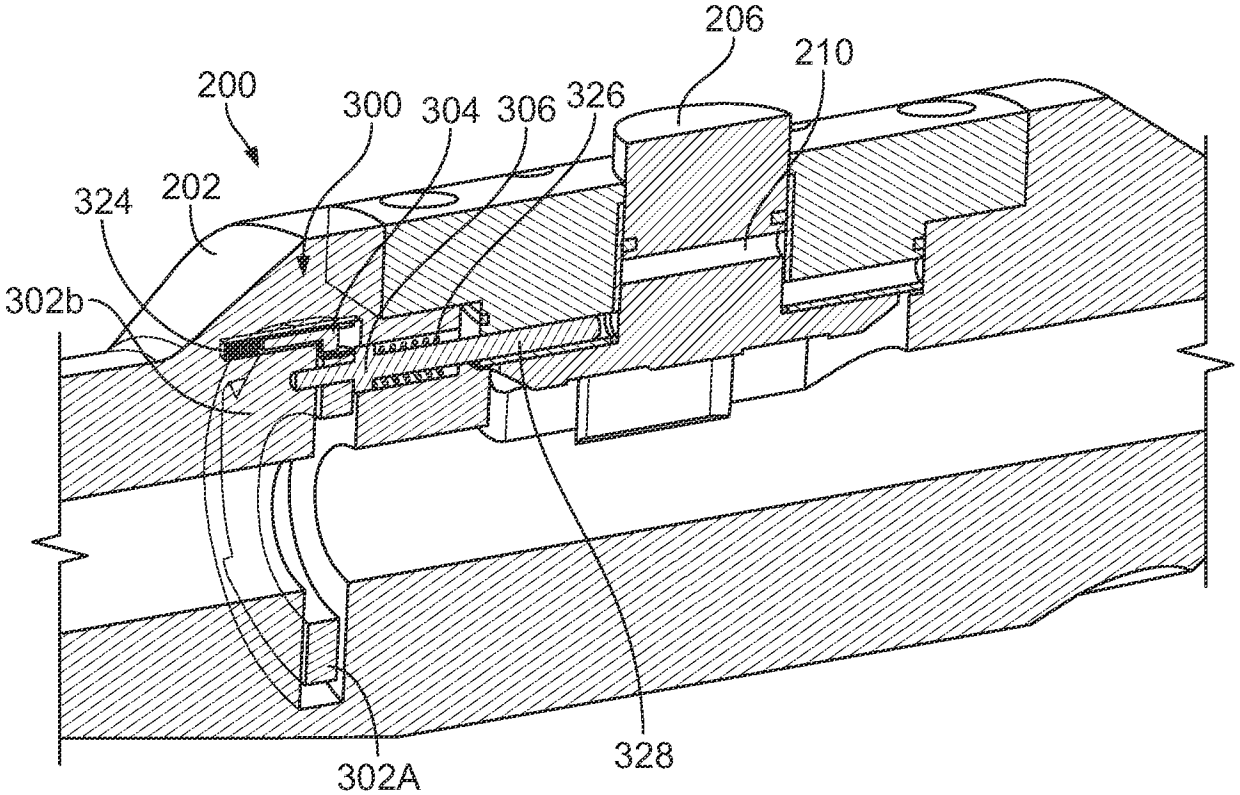
FIG. 4B is a cross-sectional view of a reamer assembly of FIG. 2 illustrating the tool activator of FIG. 3 releasing the reamer tool to the deployed position.

The activator pin 306 is movable from a deactivated position (shown in FIG. 4A) to an activated position (shown in FIG. 4B). In the deactivated position, the activator pin 306 supported against the body portion 308 of the first disk 302*a*. In this example, the activator pin 306 is urged to contact the first disk 302*a* by a linear spring 326. In the activated position, the activator pin 306 is urged by the linear spring 326 into the pin holes 314 in each of the disks 302*a* and 302*b*. As illustrated in FIGS. 4A and 4B and described in detail below, the activator pin 306 is coupled to the cutter elements 206 of the reamer tool 200 such that the cutter elements 206 are retracted into the housing 202 when the activator pin 306 is in the deactivated position. The cutter elements 206 are deployed from the housing 202 when the activator pin 306 is in the activated position.

As described in detail below, the disks 302*a* and 302*b* can be iteratively rotated by a force of the torsional spring 303 released by alternately engaging and disengaging the key member 304 with the teeth 312 of the respective disks 302*a* and 302*b*. The iterative rotation of the disks 302*a* and 302*b* facilitates movement of the activator pin 306 from the deactivated position to the activated position. In particular, the disks 302*a* and 302*b* are iteratively rotated until the pinholes 314 are aligned with the activator pin 306. In some examples, the key member 304 is moved between the first and second positions in response to pressure variations in the housing 202. In particular, a positive pressure difference between the housing 202 and the surrounding annulus 26 can provide a net hydraulic pressure force to bear on a surface 321 of the head portion 320 of the key member 304. Pressure variations in the housing 202 may be created by changes in the flow rate of the drilling fluid produced by operation of the mud pumps 22 via the controller 24. However, the present disclosure is not so limited. Any suitable method of increasing or decreasing the relative pressure can be employed without departing from the scope of the present disclosure. For example, a drop-ball method could be used to control the relative pressure.

An increase in relative pressure caused by an increased flow rate (e.g., when the mud pumps 22 are activated or operated at a high flow setting) builds a hydraulic force that acts on the surface 321 of the head portion 320 of the key member 304 and overcomes the spring force of the linear spring 324 to urge the key member 304 from the first position towards the second position. Conversely, a decrease in relative pressure caused by a decreased flow rate (e.g., when the mud pumps 22 are deactivated or operated at a low flow setting) weakens the hydraulic force applied to the key member 304, which allows the linear spring 324 to urge the key member 304 back towards the first position.

FIGS. 4A and 4B are cross-sectional views of the bottomhole assembly 100 including activator tool 300 installed in the housing 202 of the reamer tool 200. In particular, FIGS. 4A and 4B illustrate the activator pin 306 of the activator tool 300 in a deactivated position and an activated position, respectively. In this example, the disks 302*a* and 302*b* are integrally formed as a unitary structure (in contrast to the deconstructed posture shown in FIG. 3). As shown in FIG. 4A, when the activator pin 306 is in a deactivated position, supported against the first disk 302*a* by the spring 326, the elongated shaft 328 of the activator pin 306 projects into a slot 210 formed in the body of the cutter element 206. With the activator pin 306 received in the slot 210, the cutter element 206 is held in a retracted position withdrawn in the housing 202 of the reamer tool 200. In the deactivated position, the activator pin 306 holds the cutter element 206 in place in opposition to a biasing force provided by springs 212, which urge the cutter element 206 radially outward toward the deployed position. As shown in FIG. 4B when the activator pin 306 is moved to an activated position (i.e., where the activator pin 306 is urged into the pinholes 314 of the disks 302*a* and 302*b* by the spring 326), the activator pin 306 is removed from the slot 210 and the cutter element 206 is allowed to move to the deployed position in response to the biasing force of the springs 212.

Figure 5A:
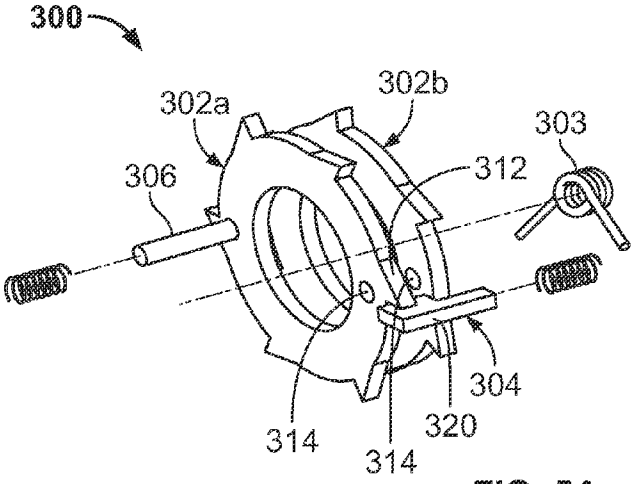
FIGS. 5A-5D are progressive diagrams illustrating limited rotation of the tool activator.
Figure 5B:
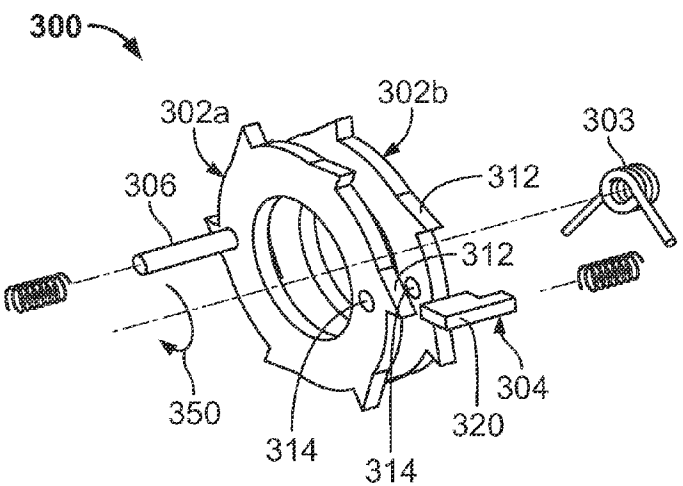
Figure 5C:
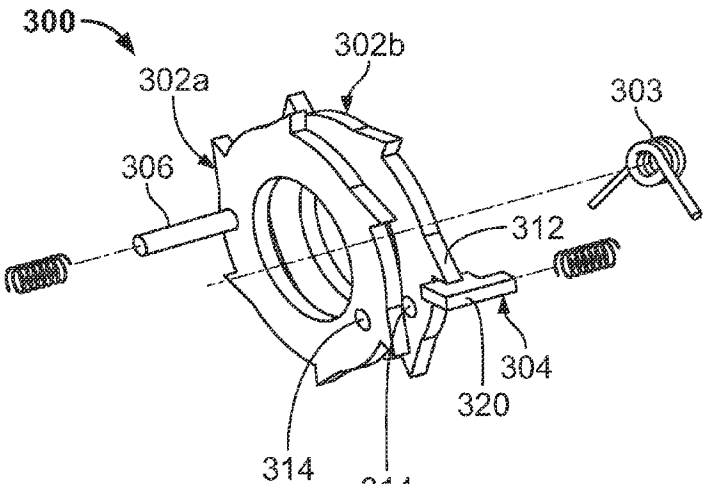

FIGS. 5A-5D are progressive diagrams of the tool activator 300 illustrating a limited rotation of the disks 302*a* and 302*b*. At FIG. 5A, the key member 304 is in the first position, with the head portion 320 engaging a tooth 312 of the first disk 302*a*. With the tooth 312 engaged by the key member 304, the spring-biased disks 302*a* and 302*b* are prevented from rotating. At FIG. 5B, the key member 304 is moved to the second position, disengaging the head portion 320 from the tooth 312 of the first disk 302*a*. Because the teeth 312 of the first and second disks 302*a* and 302*b* are offset from one another, movement of the key member 304 from the first position to the second position at this point uncouples the key member 304 completely from the disks. Thus, the disks 302*a* and 302*b* are released and permitted to rotate in the direction 350 under the urging of the torsional spring 303. FIG. 5C illustrates that the key member 304 limits the rotation of the disks 302*a* and 302*b* by engaging with a tooth 312 of the second disk 302*b*.

Figure 5D:
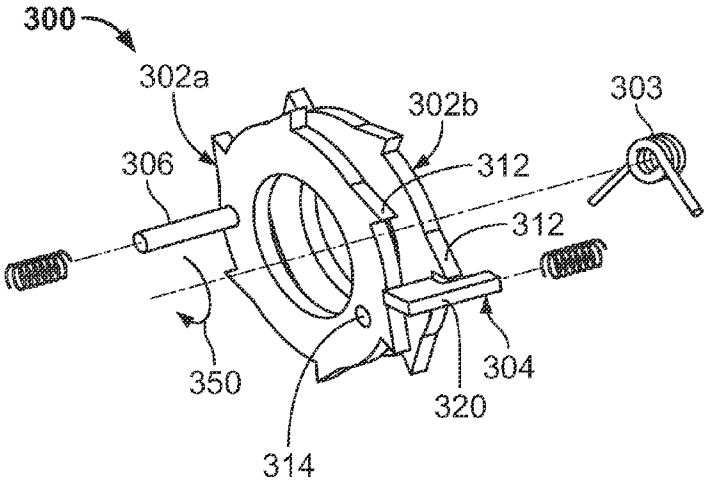

At FIG. 5D, the key member 304 is moved back to the first position, disengaging the head portion 320 from the tooth 312 of the second disk 302*b*. Again, the disks 302*a* and 302*b* are uncoupled from the key member 304 and therefore permitted to rotate through a limited angular distance until the head portion 320 of the key member 304 is met by a tooth 312 of the first disk 302*a*. In this example, the teeth of the disks 302*a* and 302*b* are arranged in a pattern that permits rotation through an angular distance of about thirty degrees with each movement of the key member 304 between the first and second positions. However, as suggested above, a configuration with more closely spaced teeth can be used to reduce the amount rotation (e.g., to twenty degrees, ten degrees or less). Conversely, a configuration with less teeth, spaced farther apart, can be used to increase the amount of rotation (e.g., to forty degrees, fifty degrees or more).

FIGS. 6A-6D are progressive diagrams illustrating the tool activator 300 undergoing a multi-stage tool activation sequence. As noted above, activation of the reamer tool's cutter elements 206 is achieved when the activator pin 306 is urged through the pin holes 314 into the activated position. FIG. 6A shows the tool activator 300 at an initial stage, with the activator pin 306 in a deactivated position and located one-hundred and eighty degrees from the pin holes 314 of the rotating disks 302*a* and 302*b*. At the first stage shown in FIG. 6B, the key member 304 has been moved through a first cycle of the key member 304 between the first and second positions to rotate the disks 302*a* and 302*b* through sixty degrees. At the second stage shown in FIG. 6C, the key member 304 member has been moved through a second cycle of the key member 304, permitting rotation of the disks 302*a* and 302*b* through ninety degrees. At the third stage shown in FIG. 6D, the key member 304 has been moved through a third cycle, permitting rotation of the disks 302*a* and 302*b* through one-hundred and eighty degrees. At one-hundred and eighty degrees of rotation by the disks 302*a* and 302*b*, the pin holes 314 are brought into alignment with the activator pin 306. The activator pin 306 is urged through the pin holes 314 by the linear spring 326 (not shown) to place the activator pin in the activated position.

FIG. 7 is a graph 400 illustrating a protocol implemented by the controller 24 for operating the tool activator 300 according to the activation sequence illustrated in FIGS. 6A-6D. In particular, the graph 400 illustrates how the controller 24 can cycle the mud pumps 22 from ON to OFF and from OFF to ON to advance the tool activator 300 through a multi-stage activation sequence. In one aspect, the graph 400 illustrates how a high flow rate created by activating the mud pumps 22 creates a relative pressure in the housing 202 that is greater than a trigger pressure. The trigger pressure corresponds to the relative pressure required to provide a hydraulic pressure force acting on the key member 304 that is sufficient to overcome a spring force of the linear spring 324 so as to drive the key member 304 from the first position to the second position. When a low flow rate is achieved by deactivating the mud pumps 22, the relative pressure falls below the trigger pressure and the spring force of the linear spring 324 drives the key member 304 back into the first position. As described above, this cycling of the key member 304 causes the disks 302*a* and 302*b* to advance the a predetermined angular distance (e.g., one-hundred and eighty degrees) through discrete stages of rotation through a limited angular distance (e.g., thirty degrees). One distinct advantage of such a multi-stage activation sequence is that unintentional activation of the wellbore tool can be avoided. For example, in the present context, premature activation of the reamer tool 200 by unintentional pressure spikes in the drill string 14 is avoided by requiring at least three pressure cycles through the trigger pressure to achieve activation.

A number of embodiments of the invention have been described. Nevertheless, it will be understood that various modifications may be made without departing from the spirit and scope of the following claims. For example, while the tool activator has been illustrated and described with reference to a reamer tool. Various other types of wellbore tools could be activated using the techniques described herein. Further, while the above examples incorporate a conventional linear spring (e.g., a coil spring or a disk spring) for providing a biasing force against the key member and the activation pin, other suitable biasing members can also be used (e.g., a gas spring or a magnetic spring). Further still, while the above examples describe an activation tool for facilitating deployment of a downhole tool (e.g., a reamer), it is also contemplated that the activation tool can also be designed to facilitate retraction of a downhole tool. Further still, while the examples discussed above involved an activator pin for controlling the wellbore tool, other configurations are also contemplated. For example, the function of the activator pin may be performed by a sliding transmission element for actuating an articulated set of cutting arms.

What is claimed is:

1. An activation assembly for a wellbore tool positionable in a wellbore, said assembly comprising:

a housing including an internal flow passage;

a wellbore tool coupled to the housing; and a tool activator operatively coupled to the wellbore tool and located within the internal flow passage of the housing, the tool activator including:

first and second fixedly connected circular disks, each disk including a plurality of radially projecting teeth disposed around an outer circumferential surface of the disk, said disks rotatably mounted about a longitudinal axis of the housing; and a key member including a head portion, the key member located within the internal flow passage such that the disks rotate through a limited angular distance in response to movement by the key member between a first position, where the head portion of the key member is engageable with the teeth of the first disk, and a second position, where the head portion of the key member is engageable with the teeth of the second disk.

2. The assembly of claim 1, wherein the teeth of the first disk are spaced apart from the teeth of the second disk along the longitudinal axis, and wherein movement of the key member between the first position and the second position comprises longitudinal movement.

3. The assembly of claim 1, wherein the head portion of the key member includes a planar surface complementary to a planar surface of each of the teeth of the disks.

4. The assembly of claim 1, wherein the teeth of the first disk are circumferentially-offset from the teeth of the second disk.

5. The assembly of claim 1, wherein the disks are integrally formed as a unitary structure.

6. The assembly of claim 1, further comprising a torsional spring urging the disks to rotate with spring force.

7. The assembly of claim 1, further comprising a biasing member urging the key member towards the first position with linear force.

8. The assembly of claim 1, wherein the limited angular distance comprises about 30 degrees.

9. The assembly of claim 1, wherein the internal flow passage of the housing is fluidly coupled to a pump providing a flow of drilling fluid therein while cycling between a low flow setting and a high flow setting to cause pressure variations within the internal flow passage, and wherein the pressure variations urge the key member to move between the first and second positions.

10. The assembly of claim 1, wherein the tool activator further comprises an activator pin coupling the wellbore tool to the disks, the activator pin being movable from a deactivated position where the wellbore tool is retracted within the housing, to an activated position, where the wellbore tool is deployed radially outward from the housing, in response to the disks rotating through a predetermined angular distance.

11. The assembly of claim 10, wherein the predetermined angular distance comprises about 180 degrees.

12. The assembly of claim 10, wherein the activator pin bears against the first disk in the deactivated position.

13. The assembly of claim 10, wherein at least the first disk includes a pin hole receiving the activator pin in the activated position.

14. The assembly of claim 1, wherein the wellbore tool coupled to the housing comprises an extendible reamer located in the housing.

15. A method for activating a wellbore tool, the method comprising:

flowing drilling fluid through a bottomhole assembly coupled to a drill string in a wellbore, the bottomhole assembly including an activation assembly including:

first and second fixedly connected circular disks, each disk including a plurality of radially projecting teeth disposed around an outer circumferential surface of the disk, said disks rotatably mounted about a longitudinal axis of a housing; and a movable key member including a head portion;

engaging the head portion of the key member with a tooth of the first disk at a first position of the key member to prevent rotation of the disks; and moving the key member from the first position to a second position to rotate the disks through a limited angular distance; and engaging the head portion of the key member with a tooth of the second disk at the second position of the key member to prevent rotation of the disks.

16. The method of claim 15, wherein moving the key member includes cycling the key member between the first and second positions to rotate the disks through a predetermined angular distance to activate the wellbore tool.

17. The method of claim 15, wherein moving the key member from the first position to the second position comprises moving the key member parallel to the longitudinal axis.

18. The method of claim 15, wherein moving the key member includes increasing a flow rate of the drilling fluid to urge the key member towards the second position by hydraulic pressure force.

19. The method of claim 15, wherein the activation assembly further includes an activator pin coupling the wellbore tool to the disks, and wherein the method further includes iteratively rotating the disks through a predetermined angular distance by alternating movement of the key member between the first and second positions to adjust the activator pin from a deactivated position where the wellbore tool is retracted within a housing of the wellbore tool, to an activated position, where the wellbore tool is deployed radially outward from the housing.

20. The method of claim 19, wherein the wellbore tool comprises a reamer tool, and wherein adjusting the activator pin to the activated position causes a cutter element of the wellbore tool to engage a wellbore wall.

* * * * *